United States Patent [19]

Kim et al.

[11] Patent Number: 4,565,776

[45] Date of Patent: Jan. 21, 1986

[54] PHOTOGRAPHIC DEVELOPER COMPOSITION

[75] Inventors: Hongzoon Kim, Boonton, N.J.; Thomas E. Salamy, North Kingstown, R.I.

[73] Assignee: Philip A. Hunt Chemical Corporation, Palisades Park, N.J.

[21] Appl. No.: 728,557

[22] Filed: Apr. 29, 1985

[51] Int. Cl.[4] ..... G03C 5/30

[52] U.S. Cl. ..... 430/467; 430/490

[58] Field of Search ..... 430/467, 468, 469, 486–493, 430/452, 464, 372, 375, 376, 377, 380, 607, 634

[56] References Cited

U.S. PATENT DOCUMENTS 2,618,558 2/1953 Vittum et al. ..... 430/493

OTHER PUBLICATIONS

Research Disclosure, Aug. 1977, pp. 28–30, #16040.

*Primary Examiner*—Mary F. Downey

*Attorney, Agent, or Firm*—Donald F. Clements; Thomas P. O'Day

[57] ABSTRACT

Oxidation inhibiting amounts of alkylated diphenyl oxide disulfonates are incorporated into photographic color developers containing primary aromatic amino color developing agents to increase clarity and inhibit the formation of tar-like precipitates in these developers. Typical disulfonates include sodium dodecyl diphenyl ether disulfonate, sodium decyl diphenyl ether disulfonate, sodium cetyl diphenyl ether disulfonate, monocetyl diphenyl ether disulfonate, dicetyl diphenyl ether disulfonate and mixtures thereof. The use of disulfonates of this type substantially eliminates the need for cosolvents such as alkanolamines to inhibit the formation of tar-like particles in the developers.

20 Claims, No Drawings

PHOTOGRAPHIC DEVELOPER COMPOSITION

This invention relates to improved photographic developing compositions. More particularly it relates to photographic developing compositions containing an oxidizing inhibiting amount of an alkyldiaryl oxide disulfolane.

Aqueous photographic developing compositions containing primary aromatic amino color developing agents have been used extensively in the development of photographs which are colored. One of the problems inherent in using these amino developing agents in developing processes is the difficulty encountered in dissolving sufficient amino color developing agent in the developing solution or composition. Very often because of oxidation by aeration of the developing composition or by reaction with other additives within the developing composition, oxidation reaction products form which tend to cloud the developing composition. In addition, tar-like droplets gradually precipitate within the developing solution thereby diminishing the content of the amino color developing agent within the developing solution. This decreases the effectiveness of the developing solution.

The tar also impairs photographic processing by adhering to the photographic materials—film or paper—being developed and the equipment used to process them. This also necessitates the frequent cleaning of photographic materials and equipment.

Numerous attempts have been made to overcome these problems. For example, British Pat. No. 669,505 which issued to Vittum et al on Apr. 12, 1950, discloses a process for enhancing the solubility of developing agents in the solvent by the addition of a small amount of an alkyl aryl sulfonate to the aqueous photographic developing solution. The alkyl substituent on the alkyl aryl sulfonate is limited to not more than 5 carbon atoms. U.S. Pat. No. 3,779,767 which issued Dec. 28, 1973 to Hasegawa et al utilizes lactose and hydroxy propylmethyl cellulose to inhibit the crystallization of the developing agent in the aqueous developing solution.

U.S. Pat. No. 4,170,478 which issued to Nelson S. Case et al on Oct. 9, 1979, adds a mixture of hydroxylamine and an alkanolamine to a developing solution containing a primary aromatic amino color developing agent to prevent aerial oxidation of the developing agent. Two antioxidants are required to accomplish the antioxidation effect.

A similar process is disclosed in U.S. Pat. No. 4,252,892 which issued to Nelson S. Case on Feb. 24, 1981, in which a poly(alkyleneimine) is added to the developing solution to prevent aerial oxidation, to reduce tar formation and retard stain growth.

Each of the above-mentioned additives provides some degree of benefit for the purpose intended. However, there is a need for a more effective and less expensive additive useful for inhibiting the formation of oxidation products in primary aromatic amino photographic developing solutions and for inhibiting the formation of tar-like particles or droplets in the developing solutions. The formation of these products and these particles substantially diminishes the effectiveness of the developing solutions. The tar-like particles not only adhere to the film or paper, but also adhere to the photographic processing equipment, thus requiring frequent cleaning.

The term "oxidation-inhibiting" is used throughout the description and claims to identify the properties of those compounds which inhibit the formation of oxidation products and/or which inhibit the formation of tar-like particles in photographic developing solutions.

It is a primary object of this invention to provide photographic developing compositions which are inhibited against the formation of oxidation products.

It is another object of this invention to provide photographic developing solutions which are inhibited against the formation of tar-like particles.

Still another object of this invention is to provide a process for improving the stability of photographic developing solutions.

It is a further object of this invention to provide a process for improving the shelf-life and useful operating life of photographic developing solutions.

A further object of the invention is to provide a photographic developing solution in which the solubility of the developing agent is enhanced, especially without the requirement for use of large quantities of cosolvents for solubility.

These and other objects of the invention will be apparent from the following detailed description of the invention.

BRIEF DESCRIPTION OF THE INVENTION

It is now been discovered that the aforesaid objects of the invention are accomplished in a photographic color developer composition comprised of a primary aromatic amino color developing agent and an oxidation inhibiting amount of an alkylated diphenyl oxide disulfonate represented by the formula:

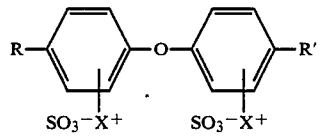

where R is a linear or branched alkyl group of from about 8 to about 20 carbon atoms where $R^1$ is R or hydrogen, and where X is an alkali metal or hydrogen. Sufficient disulfonate is added to the developing composition to increase the developer clarity and to minimize or prevent the formation of the tar-like precipitate.

DETAILED DESCRIPTION OF THE INVENTION

More in detail, any primary aromatic amino color developing agent can be stabilized with the disulfonate of this invention. Primary aromatic amino color developing agents are well known and widely used in a variety of color photographic processes. They include amino phenyl and p-phenylenediamines. They are usually used in a salt form such as the hydrochloride, phosphate, or sulfate, as the salt form is more stable than the free amine. In the developing solutions, the primary aromatic amino developing agent is generally employed in a concentration ranging from between about 0.1 to about 20 grams per liter, and preferably from about 0.5 to about 10 grams per liter of the developing composition. Typical examples of suitable polyaromatic amino color developing agents are well known to the art and are listed in numerous references such as U.S. Pat. No. 4,252,892, which issued to Nelson S. Case on Feb. 24, 1981. This reference is incorporated in its entirety in this application by reference.

The primary aromatic amino color developing agents are selected from the group consisting of: 4-amino-N-ethyl-N-(β-methanesulfonamido-ethyl)-m-toluidine, 4-amino-N,N-diethylaniline, 2-amino-5-(N-ethyl-N-β-hydroxyethyl-amino)-toluene, N,N-diethyl toluene-2,5-diamine, 4-amino-3-(β-methylsulfonamidoethyl)-N,N-diethyl aniline, and 4-(N-ethyl-N-2-methoxyethyl)-2-methyl phenylenediamine di-p-toluene. The salts of these compounds, such as the hydrochloride, sulfate, phosphate, and the like can also be employed as the developing agent. Other suitable color developing agents are described, for example in Journal of the American Chemical Society, Vol. 73, p. 3100 (1951).

Preferably the primary aromatic amino color developing agent is selected from the group consisting of 4-amino-N-ethyl-N-(β-methanesulfonamidoethyl)-m-toluidine monophosphate, 4-amino-N-ethyl-N-(β-methanesulfonamidoethyl)-m-toluidine monophosphate monomethanolate, 4-amino,N-ethyl-N-(β-methanesulfonamido-ethyl)-m-toluidine sulfate and the like.

Suitable alkylated diphenyloxide disulfonates useful as a stabilizer or antioxidant in this invention are represented by the formula:

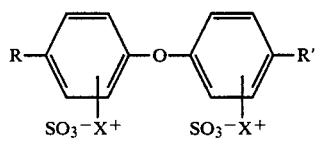

where R is a linear or branched alkyl group having from between about 8 and about 20 carbon atoms, and preferably from between about 10 and about 16 carbon atoms, where $R^1$ is R or hydrogen and where X is hydrogen or an alkali metal.

Preferred examples of suitable disulfonates include sodium decyl diphenyl ether disulfonate, sodium dodecyl diphenyl ether disulfonate, sodium cetyl diphenyl ether disulfonate, monocetyl diphenyl ether disulofonate, dicetyl diphenyl ether disulfonate, mixtures thereof, and the like.

A sufficient amount of the disulfonate is added to the primary aromatic amine developing composition to inhibit the formation of tar-like precipitate and to improve and increase the clarity of the photographic color developing composition. This oxidation inhibiting amount generally ranges from about 0.1 to about 20, and preferable from about 0.2 to about 10 grams of the disulfonate per liter of the photographic color developing solution.

Mixing of the disulfonate with the photographic developing solution can be effected by any convenient mixing techniques. For example, the disulfonate is admixed with the components of the photographic developing solution at ambient temperatures and pressure. Suitable mixing temperatures are in the range from about 20° to about 30° C., but any suitable temperature may be employed if desired. When the photographic developing solution is mixed with an oxidizing inhibiting amount of the disulfonate of this invention, not only is the clarity of the developing solution improved, but the formation of tar-like precipitate is inhibited. Without being bound by theory, it is believed that the disulfonate compound enhances the solubility of the primary amino developing agent in the developing composition and thereby inhibits precipitation or oxidation of the primary amino developing agent. In addition, it may inhibit the reaction of the developing agent with other components of the developing composition.

The following Examples are presented in order to define the invention more fully. All parts and percentages are by weight unless otherwise specified.

EXAMPLES 1-3

Four photographic color developer solutions each one liter in volume, were prepared in which the primary aromatic amino color developing agent was 4-amino-N-ethyl-N-(β-methanesulfonamidoethyl)-m-toluidine monophosphate monomethanolate.

The formula levels were as follows:

| Component | Quantity Grams/Liter |
|---|---|
| Ethylene glycol | 13.2 |
| Benzyl alcohol | 18.8 |
| Stain reducing agent* | 0.5 |
| Hydroxylamine sulfate | 4.0 |
| Potassium sulfite | 2.3 |
| Developing agent | 6.0 |
| Chelating agent (Hydroxyethylidene diphosphonic acid) | 1.0 |
| Boric acid | 0.3 |
| Potassium carbonate | 30.0 |
| Potassium hydroxide to pH | 10.4 |
| Water | balance |

*Stilbene derivative sold commercially by CIBA-GEIGY under the trademark TINOPAL To three of the developer solutions identified as Examples 1, 2 and 3 respectively the following disulfonate compounds were added using 0.75 g/L of each. To the fourth solution, identified as "Comparative Test A" no additives were made.

Example 1: sodium dodecyl diphenyl ether disulfonate.
Example 2: sodium decyl diphenyl ether disulfonate.
Example 3: sodium cetyl diphenyl ether disulfonate.

All of the color developer solutions were stored at room temperature in glass beakers and observed initially and hourly for solution appearance and clarity and formation of precipitation of darkly colored, tar-like droplets or particles.

The results of solution appearance and tar deposition are as follows:

| | RESULTS | |
|---|---|---|
| Examples | Initial Appearance | Hrs. till tar deposition |
| 1 | Clear | >72 |
| 2 | Clear | >72 |
| 3 | Clear | >72 |
| Comparative Test A | Hazy | 3 |

The initial appearance of the color developer solution of Comparative Test A, without addition of the disulfonated diphenyl oxide, showed haziness and turbidity in the solution. In contrast, the appearance of Examples 1, 2 and 3, to which the disulfonate were added had been added showed the color developer solutions were clear. After three hours the color developer solution without any disulfonate compound of Comparative Test A contained a precipitate of tar. In contrast, the compounds of the invention to which disulfonates were added had delayed formation of the tar-like particles for a considerable time period.

EXAMPLE 4

Six photographic color developer solutions, each of one liter in volume, in which the primary aromatic amino color developing agent was 4-amino-N-ethyl-N-(β-methanesulfonamidoethyl)-m-toluidine monophosphate monomethanolate, were prepared. The solutions were identified as Example 4 and Comparative Tests B–F, respectively. Each of the solutions had the following composition:

| Compound | Proportion grams/liter |
|---|---|
| Hydroxylamine sulfate | 4.0 |
| Lithium chloride | 2.5 |
| Ethylene glycol | 8.0 |
| Benzyl alcohol | 18.8 |
| Stain reducing agent (CIBA-GEIGY TINOPAL SFP) | 0.5 |
| Phosphoric acid, 85% | 0.5 |
| Developing agent | 6.2 |
| Sodium sulfite | 1.8 |
| Potassium carbonate | 31.0 |
| Chelates - HEDPA | 1.75 |
| and Nitrilo triacetic acid | 0.5 |
| Sodium gluconate | 0.3 |
| Potassium hydroxide | to pH 10.5 |
| Water to make | 1000 ML |

To these solutions the following additions were made and the following reactions were observed:

| Solution Number | Grams/Liter Disulfonate* | /TEA** | Initial Haze | Precipitation Formation |
|---|---|---|---|---|
| Ex. 4 | 1 | — | Clear | Aft. 10 days none |
| B | — | — | Cloudy | Aft. 2 hrs. |
| C | — | 5 | Cloudy | 24 hours |
| D | — | 10 | Cloudy | 24 hours |
| E | — | 15 | Hazy | 24 hours |
| F | — | 20 | Slightly Hazy | 24 hours |

*45% solution of mono and didecyl diphenyl oxide disulfonate
**Triethanolamine

Visual examination showed that Comparative Test B without any additions was initially very hazy and showed precipitation after only two hours. Comparative Tests C–F, while having varying degrees of cloudiness which improved as the level of TEA was increased, all showed some precipitation after 24 hours, although not as heavily as Comparative Test A. Only Example 4 showed no precipitation even after 10 days, and only required 1 g/L of additive to produce an initially clear solution.

These data demonstrate that the novel disulfonate antioxidants of this invention increase the clarity and prevent precipitation in a color developer solution containing a primary aromatic amine color developing agent without the use of increased cosolvent concentrations such as alkanolamines.

Comparative Tests G and H

A procedure similar to Example 4 was employed using 0.8 grams per liter of xylene sulfonate (Comparative Test G) and 5.0 grams per liter of pyrocatecol disulfonate (Comparative Test H) instead of the alkylated diphenyl oxide disulfonate of Example 4. Neither additive was effective in inhibiting the formation of tar in the photographic developing solution.

What is claimed is:

1. A photographic color developer composition comprising, (1) a primary aromatic amino color developing agent and, (2) an oxidation inhibiting amount of an alkylated diphenyl oxide disulfonate represented by the formula:

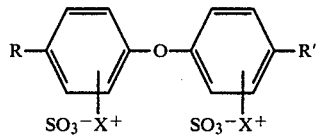

where R is a linear or branched alkyl group of between about 8 and about 20 carbon atoms, where $R^1$ is R or hydrogen, and where X is an alkali metal or hydrogen.

2. The developer composition of claim 1 wherein said disulfonate is selected from the group consisting of sodium dodecyl diphenyl ether disulfonate, sodium decyl diphenyl ether disulfonate, sodium cetyl diphenyl ether disulfonate, monocetyl diphenyl ether disulfonate, dicetyl diphenyl ether disulfonate and mixtures thereof.

3. The developer composition of claim 2 wherein said oxidation inhibiting amount of said disulfonate is from between about 0.1 and about 20 grams per liter of said developer composition.

4. The developer composition of claim 2 wherein said oxidation inhibiting amount of said disulfonate is from between about 0.2 and about 10 grams per liter of said developer composition.

5. The developer composition of claim 3 wherein said developing agent is selected from the group consisting of the sulfate, phosphate, and chloride salts of 4-amino-N-ethyl-N-(β-methanesulfonamido-ethyl)-m-toluidine.

6. The developer composition of claim 3 wherein said developing agent is 4-amino-N-ethyl-N-(β-methanesulfonamidoethyl)-m-toluidine monophosphatemonomethanolate.

7. The developer composition of claim 4 wherein said developing agent is 4-amino-N-ethyl-N-(β-methanesulfonamidoethyl)-m-toluidine sulfate.

8. The developer composition of claim 4 wherein said disulfonate is sodium dodecyl diphenyl ether disulfonate.

9. The developer composition of claim 4 wherein said disulfonate is sodium decyl diphenyl ether disulfonate.

10. The developer composition of claim 4 wherein said disulfonate is sodium cetyl diphenyl ether disulfonate.

11. The process for inhibiting the oxidation of a primary aromatic amino color developing agent in a photographic color developer composition which comprises admixing with said developer composition an oxidation inhibiting amount of alkylated diphenyl oxide disulfonate represented by the formula:

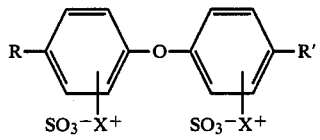

12. The process of claim 11 wherein said disulfonate is selected from the group consisting of sodium dodecyl diphenyl ether disulfonate, sodium decyl diphenyl ether disulfonate, sodium cetyl diphenyl ether disulfonate,- monocetyl diphenyl ether disulfonate, dicetyl diphenyl ether disulfonate and mixtures thereof.

13. The process of claim 12 wherein said oxidation inhibiting amount of said disulfonate is from between about 0.1 and about 20 grams per liter of said developer composition.

14. The process of claim 12 wherein said oxidation inhibiting amount of said disulfonate is from between about 0.2 and about 10 grams per liter of said developer composition.

15. The process of claim 13 wherein said developing agent is selected from the group consisting of the sulfate, phosphate, and chloride salts of 4-amino-N-ethyl-N-(β-methanesulfonamido-ethyl)-m-toluidine.

16. The process of claim 14 wherein said developing agent is 4-amino-N-ethyl-N-(β-methanesulfonamidoethyl)-m-toluidine monophosphate monomethanolate.

17. The process of claim 14 wherein said developing agent is 4-amino-N-ethyl-N-(β-methanesulfon-amidoethyl)-m-toluidine sulfate.

18. The process of claim 14 wherein said disulfonate is sodium dodecyl diphenyl ether disulfonate.

19. The process of claim 14 wherein said disulfonate is sodium decyl diphenyl ether disulfonate.

20. The process of claim 14 wherein said disulfonate is sodium cetyl diphenyl ether disulfonate.

* * * * *